US006377246B1

(12) United States Patent
Wild

(10) Patent No.: US 6,377,246 B1
(45) Date of Patent: Apr. 23, 2002

(54) ARTICLE COMPRISING A COMPUTER-STYLE KEYBOARD

(75) Inventor: Ronald Lee Wild, Carmel, IN (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/008,047

(22) Filed: Jan. 16, 1998

(51) Int. Cl.[7] ..... G09G 5/00

(52) U.S. Cl. ..... 345/168; 341/20; 341/22; 341/23; 379/439; 379/437; 379/447; 379/452

(58) Field of Search ..... 345/168, 170; 379/452, 439, 451, 437, 447, 96; 341/22, 23, 20; 705/25; 350/331

(56) References Cited

U.S. PATENT DOCUMENTS

| | | | | | |
|---|---|---|---|---|---|
| 4,336,529 | A | * | 6/1982 | Buan | 705/25 |
| 4,555,600 | A | * | 11/1985 | Morse | 179/184 |
| 4,644,326 | A | * | 2/1987 | Villalobos et al. | 345/170 |
| 4,671,688 | A | * | 6/1987 | Brashears | 340/365 |
| 4,862,499 | A | * | 8/1989 | Jeket et al. | 379/368 |
| 4,948,281 | A | * | 8/1990 | Werner | 400/472 |
| 5,123,044 | A | * | 6/1992 | Tate | 379/451 |
| 5,483,418 | A | * | 1/1996 | Hosoi | 361/680 |
| 5,515,424 | A | * | 5/1996 | Kenny | 379/96 |
| 5,575,576 | A | * | 11/1996 | Roysden, Jr. | 341/22 |
| 5,982,357 | A | * | 11/1999 | Burgett et al. | 345/168 |

FOREIGN PATENT DOCUMENTS

| | | | | |
|---|---|---|---|---|
| DE | 5574446 | * | 11/1996 | 345/168 |
| JP | 4723836 | * | 2/1988 | 650/331 |

* cited by examiner

*Primary Examiner*—Richard Hjerpe
*Assistant Examiner*—Ali A. Zamani
(74) *Attorney, Agent, or Firm*—Priest & Goldstein, PLLC

(57) ABSTRACT

An improved keyboard, and a data terminal incorporating same, is disclosed. The present keyboard advantageously includes a keyboard membrane having, on an upper side, a plurality of raised regions upon which character designators can be placed. A plurality of upper key members are disposed on a lower side of the keyboard membrane. Each upper key member is advantageously structurally adapted to return itself, after removal of an actuating force, to an unactuated position. The raised regions on the upper side, and the upper key members on the lower side of the keyboard membrane are advantageously molded from a single elastomeric layer, thereby replacing hundreds of parts in conventional computer-style keyboards using sliding-plunger type key mechanisms. A plurality of lower key members are disposed on a circuit board underneath the keyboard membrane. The lower key members are structurally adapted to prevent "rock over" when a user depresses a raised region somewhat off-center. In some embodiments, the present keyboard advantageously includes a wire braid disposed on the keyboard membrane that functions as a flexible armor to protect underlying keyboard elements. The protective braid is physically adapted to engage features near an edge of the keyboard membrane so that the wire braid can be secured to the keyboard. In addition to possessing features suitable for engaging the protective braid, the keyboard membrane advantageously includes a seal for engaging a keyboard housing. When so engaged, the seal provides a substantially liquid-resistant keyboard.

6 Claims, 8 Drawing Sheets

ARTICLE COMPRISING A COMPUTER-STYLE KEYBOARD

FIELD OF THE INVENTION

The present invention relates generally to terminals for entering data. More particularly, the present invention relates to a robust, low-cost keyboard suitable for use in adverse environments.

BACKGROUND OF THE INVENTION

Some public telephones use a computer-style keyboard to provide data terminal emulation. This allows the public access to e-mail, data bases, the Internet, deaf terminal communication and the like. A keyboard situated in a public environment ("public-use keyboard") is typically subjected to substantially more adverse conditions than a keyboard that is used within the home or in a corporate setting. For example, public-use keyboards may be located out-of-doors and thus exposed to the prevailing weather conditions (e.g., rain, sleet, etc.). And, perhaps even more problematic, such public-use keyboards are often vandalized.

Public-use computer-style keyboards are relatively expensive. One reason for the expense is the ubiquitous "sliding-plunger" key mechanism. The sliding-plunger key mechanism uses, for each key, a plunger, a key cap glued to the plunger, and a spring for providing a restoring force to the plunger. Those three parts, and sometimes more, are required for each of the over one hundred keys on a keyboard. Such a large number of parts represents a significant cost factor for such keyboards.

A second reason for the relatively high cost of such public-use keyboards relates to the use of vandalism-prevention measures. In particular, public-use keyboards are often stored within a mechanized metal drawer. The keyboard is accessible only after a user enters credit card information. The drawer is a relatively expensive item and represents a second significant cost factor for a public-use keyboard.

It would be desirable, especially in view of a relatively short life span, to develop lower cost computer-style keyboards for public use.

SUMMARY OF THE INVENTION

An article comprising an improved keyboard in accordance with an illustrated embodiment of the present invention is disclosed. The present keyboard advantageously includes a keyboard membrane having, on an upper side, a plurality of raised regions upon which character designators are disposed. Each of such designated raised regions is analogous to a key cap of a conventional keyboard. A user depresses such raised regions to "type" on the present keyboard.

A plurality of upper key members are disposed on a lower side of the keyboard membrane. One upper key member is disposed directly underneath each one of the raised regions. Each upper key member is structurally adapted to provide a restoring force that, after removal of an actuating force, causes the upper key member to return to an unactuated position.

In some embodiments, the keyboard membrane is formed from a layer of flexible, resilient, elastomeric material. The raised regions on the upper side, and the upper key members on the lower side are advantageously molded from the elastomeric layer so that the keyboard membrane, the plurality of raised regions and the plurality of upper key members may comprise a single part or be divided into a small number of parts comprising different regions of the keyboard. Thus one part or a substantially reduced number of parts may replace over two hundred parts in conventional computer-style keyboards using sliding-plunger type key mechanisms.

A plurality of lower key members are disposed on a circuit board underneath the keyboard membrane. The lower key members are structurally adapted to prevent "rock over" (i.e., a deviation in the downward path of an upper key member resulting in a mis-strike) when an actuating force is applied off-center on the raised region.

In some embodiments, the present keyboard advantageously includes a wire braid disposed on the keyboard membrane that functions as a flexible armor to protect underlying keyboard elements. The protective braid is physically adapted to engage features of the keyboard membrane whereby the wire braid is securable to the keyboard. Additionally, in some embodiments, the keyboard membrane advantageously includes a seal for preventing liquid (e.g., rain, drink spills, etc.) from penetrating the keyboard housing. Such a seal provides for a substantially liquid-resistant keyboard.

DETAILED DESCRIPTION

Figure 1:
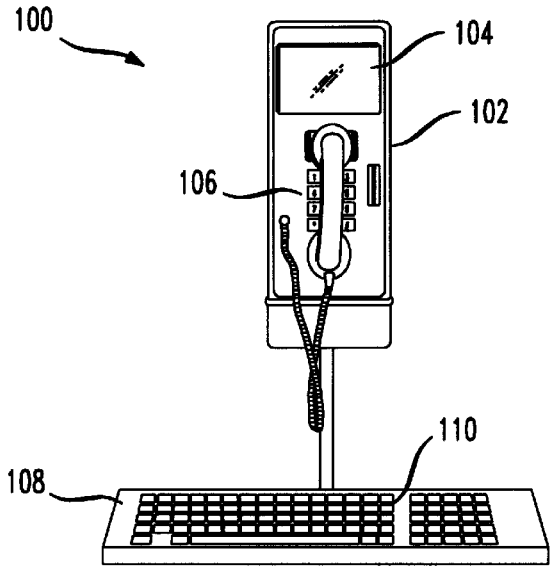
FIG. 1 depicts a telephone with a computer-style keyboard and display in accordance with an illustrative embodiment of the present invention.

FIG. 1 depicts article 100 for data terminal emulation in accordance with an illustrative embodiment of the present invention. Article 100 includes telephone 102 having display 104 and keypad 106, and computer-style keyboard 108. Article 100 enables a user to access e-mail, data bases, the Internet, deaf terminal communication, and like services.

In operation, a user enters an appropriate access number on telephone 102 using keypad 106 and sends appropriate identifying information via keys 110 of keyboard 108. Once the user accesses the desired service, communication continues using keyboard 108 to enter information, and display 104 to view responses.

Figure 2:
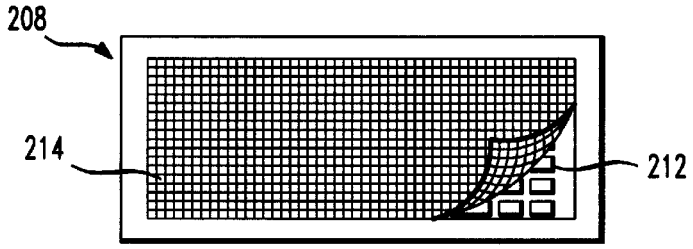
FIG. 2 depicts a computer-style keyboard with a protective wire braid in accordance with an illustrative embodiment of the present invention.

FIG. 2 depicts a keyboard with optional protective armor. In the illustrated embodiment, the protective armor is wire braid 214, which advantageously covers face 212 of keyboard 208 protecting underlying components. Stainless steel or other corrosion resistant and suitably robust wire in the range of about 0.001–0.003 inches diameter may be used for forming wire braid 214. In some embodiments, character designators 210 (not shown) can be imprinted or selectively plated on wire braid 214, as described in more detail below.

Figure 3:
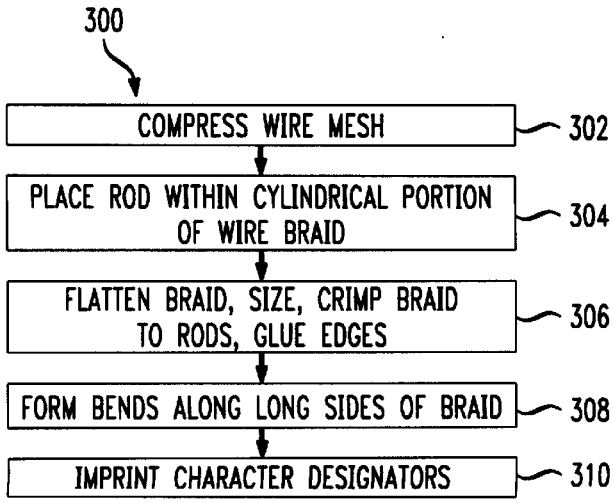
FIG. 3 depicts a flow chart of a method for making the protective wire braid of FIG. 2.
Figure 4:
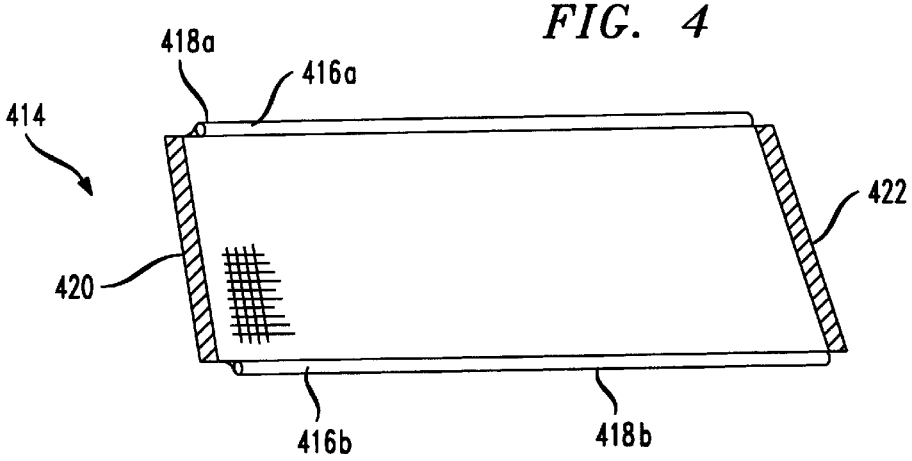
FIGS. 4 & 5 depict the protective wire braid at stages during its manufacture.

FIG. 3 depicts a flow diagram of method 300 for applying the protective the protective wire braid in accordance with the present invention. As indicated in operation block 302, a cylindrical section of wire mesh is compressed along its axial direction to provide a resilient stretching capability. The mesh may be compressed in any convenient manner. In one embodiment, the wire mesh is compressed by slipping it over a cylinder or dowel and applying a downwardly-directed force to an upper end of the wire mesh cylinder. As the force is applied, the mesh collapses, forcing the individual wires of the mesh into abutting relation, thereby forming a wire "braid." Referring to operation block 304, two rods comprised of suitably robust and corrosion resistant material, such as stainless steel, are placed in diametrical opposition within the cylindrical section of wire braid. In accordance with operation block 306, the braid is flattened to form a rectangularly-shaped double-layer. The axially-compressed cylindrical section of wire braid must have a diameter suitable for covering the face of a keyboard from top to bottom (e.g., face 212 of keyboard 208 in FIG. 2). A four or five inch diameter cylinder of wire braid is expected to be suitable for most applications. Once flattened, the braid is cut to match the long dimension (i.e., left side to right side) of the keyboard. FIG. 4 depicts nascent protective wire braid 414 after flattening.

As illustrated in FIG. 4, rods 416*a,* 416*b* are aligned with the long dimension of nascent wire braid 414 and are disposed at respective opposed edges 418*a,* 418*b* thereof. The braid encircling rods 416*a,* 416*b* is crimped tightly thereto. The crimped braid is fixed to the rods, such as by gluing with epoxy or other suitable adhesive. Short edges 420, 422 are clamped and glued.

As indicated in operation block 308, two bends 524*a,* 524*b,* running parallel to respective rods 416*a,* 416*b,* are formed near each of edges 418*a,* 418*b* of the wire braid. (See FIG. 5) As described further below, the bends and rods cooperate with other features of the present keyboard to secure the protective wire braid to the keyboard.

Character designators are printed on the braid, such as by silk screening, as noted in operation block 310. Alternatively, the character designators can be created using selective electroplating, wherein copper or other materials having a color that contrasts with the color of the wire braid is used to form the character designators and key outlines. With this letter approach, a plating resist is applied to the wire braid at other regions to inhibit plating outside the areas where characters are to be formed.

It should be understood that the present keyboard is also suitable for use in environments in which the risk of vandalism is low (e.g., home or office). In such environments, the protective wire braid is not required, but may be employed if the environment requires robustness. For example, robustness may be desired in a keyboard for small children or in a factory.

Figure 6:
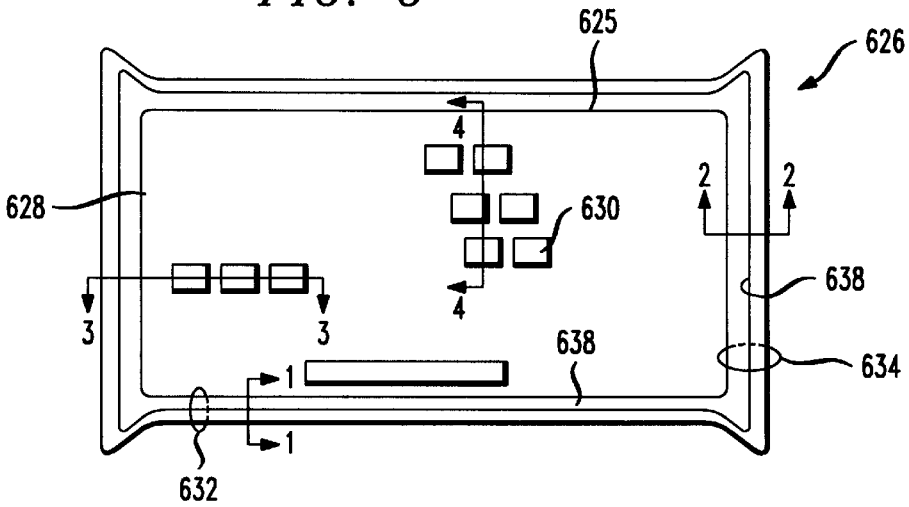
FIG. 6 depicts a view of an upper surface of a keyboard membrane.

FIG. 6 depicts a view of upper surface 628 of a keyboard membrane 626 in accordance with an illustrative embodiment of the present invention. A plurality of raised regions 630 are disposed on upper surface 628. Each of such raised regions 630 is analogous to a key cap of a conventional keyboard. A user depresses such raised regions to "type" on the present keyboard. In some embodiments, character designators can be imprinted on raised regions 630. In embodiments wherein the keyboard includes a protective wire braid with character designators imprinted thereon that is disposed over upper surface 628, character designators need not be imprinted on raised regions 630.

In some embodiments, keyboard membrane 626 is preferably formed from a layer 625 of flexible, resilient, elastomeric material, such as silicon rubber or the like. Raised regions 630 are advantageously molded or otherwise formed within layer 625 so that they are integral therewith (i.e., form a portion of the upper surface 628).

In some embodiments, regions near the edges of keyboard membrane 626 are advantageously physically adapted to provide a substantially liquid-tight seal when appropriately engaged to a keyboard housing. In the illustrative embodiment depicted in FIG. 6, one such physical adaptation is seal bead 638. Seal bead 638 advantageously forms a continuous ridge near the edge of the upper surface 628 of the upper keyboard portion. Seal bead 638, and other features of keyboard membrane 626 are described in more detail below in conjunction with FIGS. 7–10.

Figure 7:
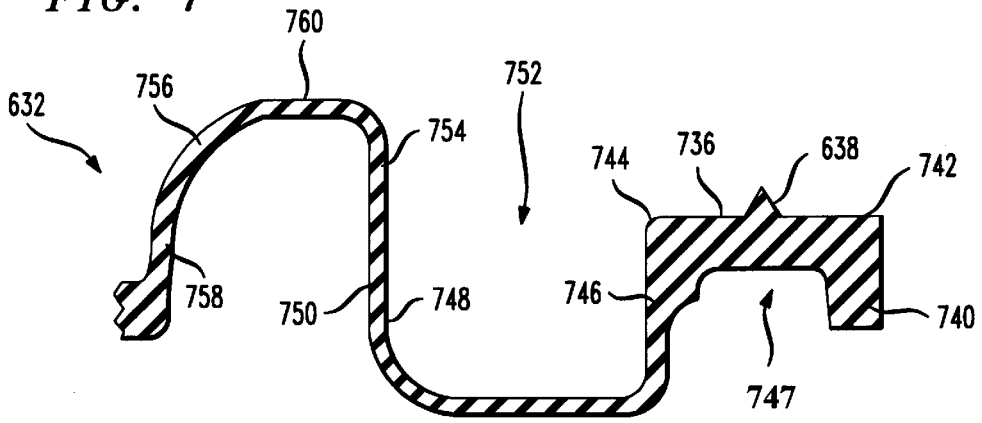
FIG. 7 depicts a cross-sectional view of the keyboard membrane of FIG. 6 along line 1—1.

FIG. 7 shows a cross-sectional view of edge region 632 of keyboard membrane 626 along line 1—1 (FIG. 6). In the illustrative embodiment depicted in FIG. 7, seal bead 638 is configured as a ridge extending above flat portion 736 of edge region 632 on upper surface 628. Tab 740 and channel wall 746 depend from respective first and second ends 742, 744 of flat portion 736. Channel wall 746 and tab 740 define downward-facing channel 747. Channel wall 746 and lower portion 748 of first riser wall 750 define upward-facing channel 752. Upper portion 754 of first riser wall 750 and upper portion 756 of second riser wall 758 define riser 760. Edge region 632 is advantageously configured, as described above, to achieve specific functions that are described below with reference to FIG. 8.

Figure 8:
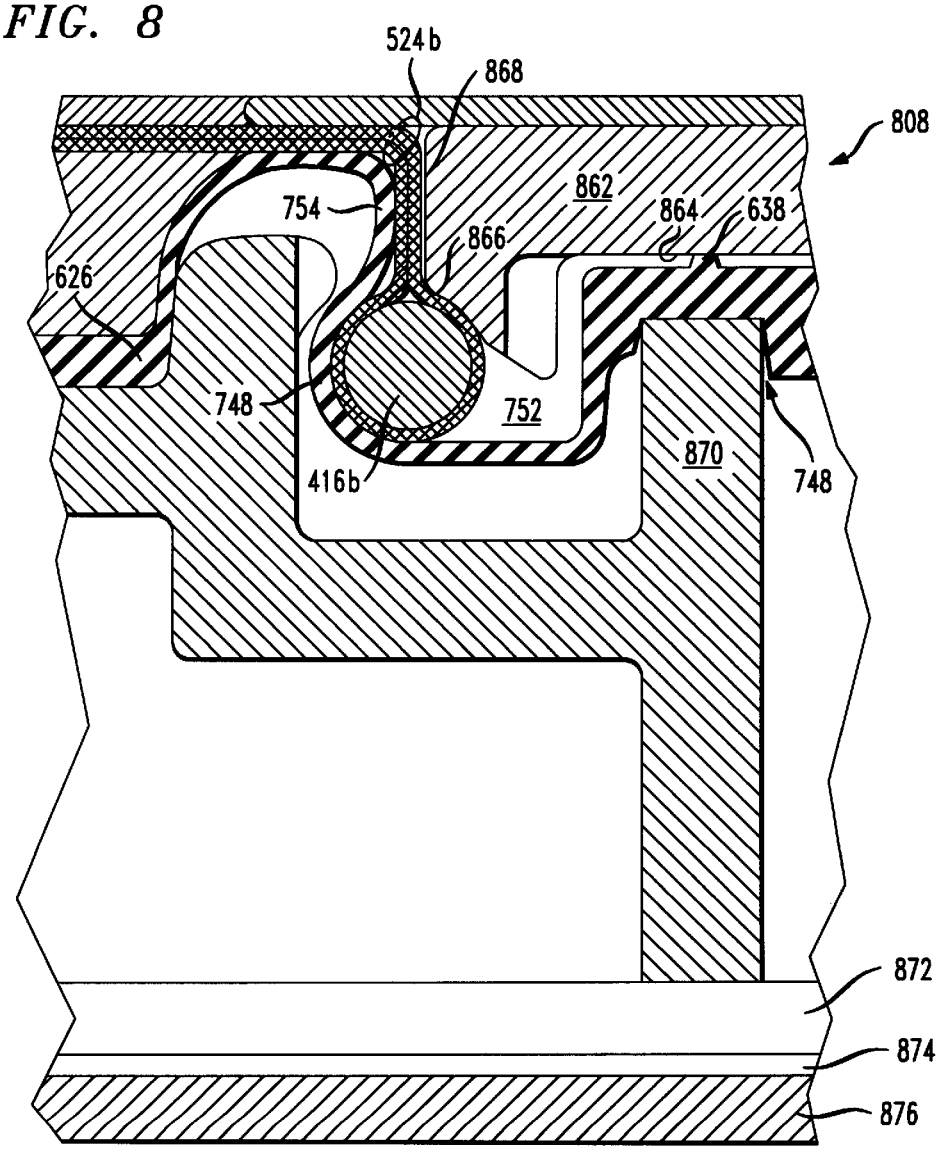
FIG. 8 depicts a cross-sectional view, from the same perspective as FIG. 7, through a computer-style keyboard in accordance with an illustrative embodiment of the present invention.

FIG. 8 shows a cross-sectional view from the same perspective of FIG. 7, but extending completely through keyboard 808 to depict edge region 632 of keyboard membrane 626 engaging keyboard housing 862. Key spacer frame 870 supports keyboard membrane 626 and presses seal bead 638 against undersurface 864 of keyboard housing 862. Tight-fitting abutment of seal bead 638 and undersurface 864 creates a substantially liquid-tight seal that prevents liquid from penetrating to the interior of keyboard 808. Key spacer frame 870 is received, at edge region 632, by downward-facing channel 748. Key spacer frame 870 is disposed on circuit board 872. Layer 874 of an electrically-insulating material is disposed between circuit board 872 and plate 876. Plate 876, which is typically steel, forms the bottom of keyboard 808.

Upward-facing channel 752 is advantageously configured to receive one of the rods, for example, rod 416*b*. Formed of flexible and resilient material, lower portion 748 of first riser wall 750 deforms to accept rod 416*b*. Due to its resilient nature, the first riser wall forces the rod against angled edge 866 of keyboard housing 862. Moreover, in response to the outwardly-directed deformation of lower portion 748, a pinch point is formed wherein upper portion 754 of first riser wall 750 deforms towards vertical edge 868 of the keyboard housing. The portion of the braid between bend 524*b* and the rod 416*b* is tightly squeezed at the pinch point, thereby securing the rod and the protective braid to keyboard 808.

Figure 9:
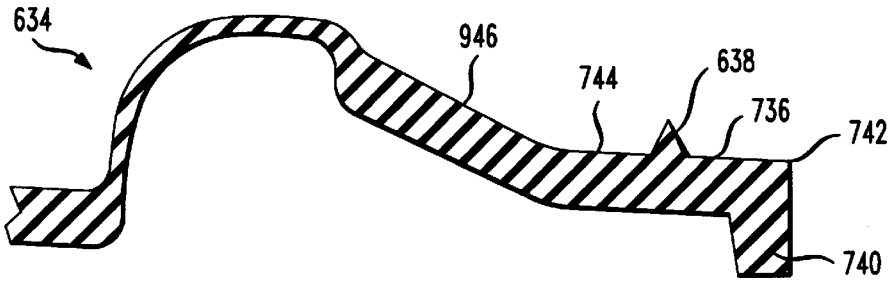
FIG. 9 depicts a cross-sectional view of the keyboard membrane of FIG. 6 along line 2—2.

FIG. 9 shows a cross-sectional view of edge region 634 of keyboard membrane 626 along line 2—2 (FIG. 6). Edge region 634 includes seal bead 638 extending above flat portion 736. Tab 740 depends from first end 742 of flat portion 736. Inclined region 946 depends from second end 744 of flat portion 736. Unlike edge region 632, edge region 634 does not include structural adaptations for retaining a rod, such as rod 416*b*, since rods are not present in edge region 634. Rather, edge region 634 has a profile that allows it to abut key spacer frame 870 in a close-fitting engagement, as depicted in FIG. 10.

Figure 10:
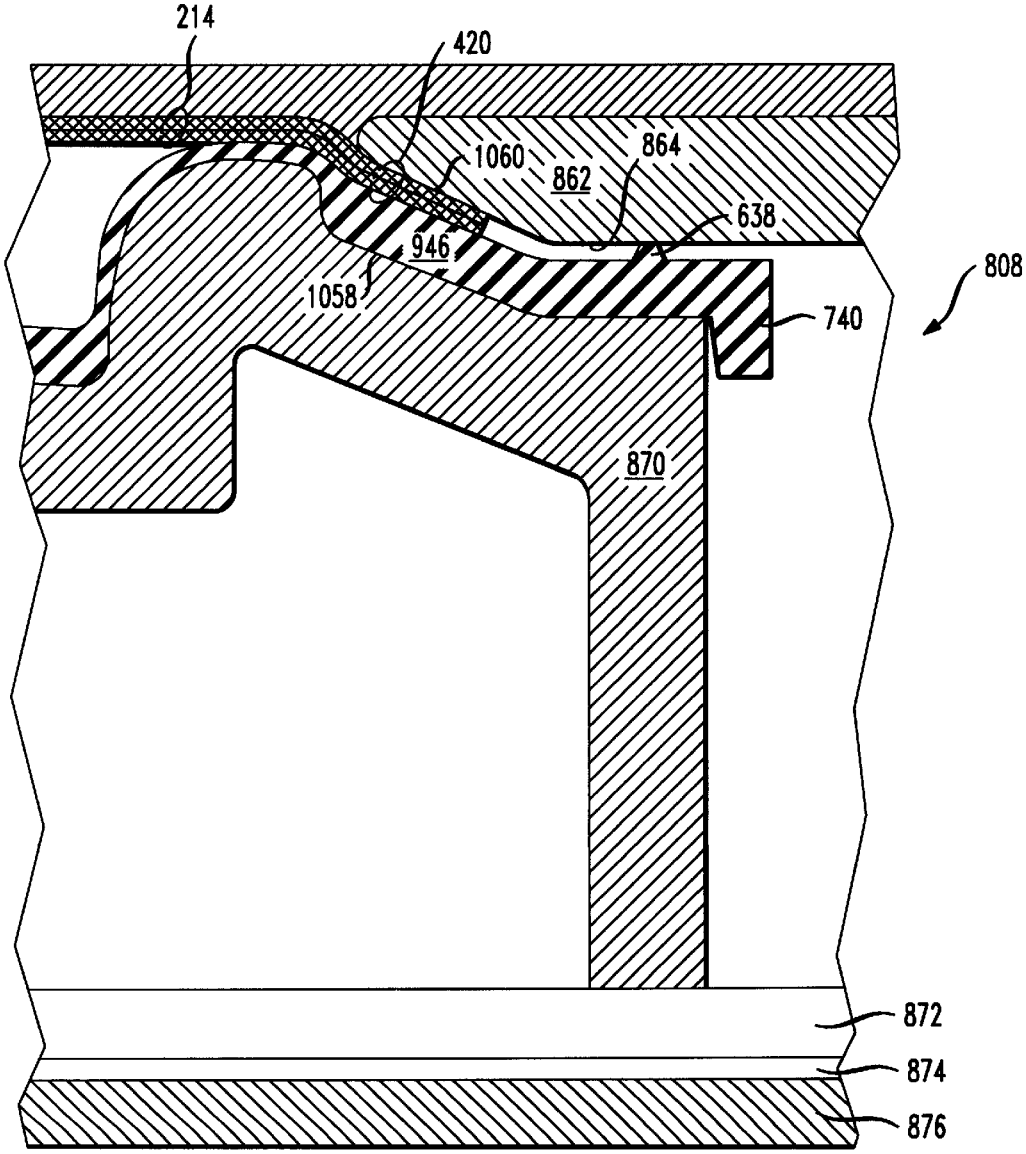
FIG. 10 depicts a cross-sectional view, from the same perspective as FIG. 9, through a computer-style keyboard in accordance with an illustrative embodiment of the present invention.

FIG. 10 shows a cross-sectional view from the same perspective as FIG. 9 but extending completely through keyboard 808 to depict edge region 634 engaging keyboard housing 862. Note that the cross section through the short side of key spacer frame 870, as shown in FIG. 10, is different from the cross section through its long side (as shown in FIG. 8).

As before, seal bead 638 of edge region 634 abuts undersurface 864 of keyboard housing 862 forming a substantially liquid-tight seal, and tab 740 overlaps key spacer frame 870. Inclined region 946 is supported by inclined surface 1058 of key spacer frame 870. Short edge 420 of protective braid 214 is pinched between inclined region 946 and inclined surface 1060 of keyboard housing 862.

It should be understood that the edge region located along the other "long side" of the upper keyboard portion has the same cross section as edge region 632. Similarly, it will be appreciated that the edge region located along the other "short side" of the upper keyboard portion has the same cross section as edge region 634.

Figure 11:
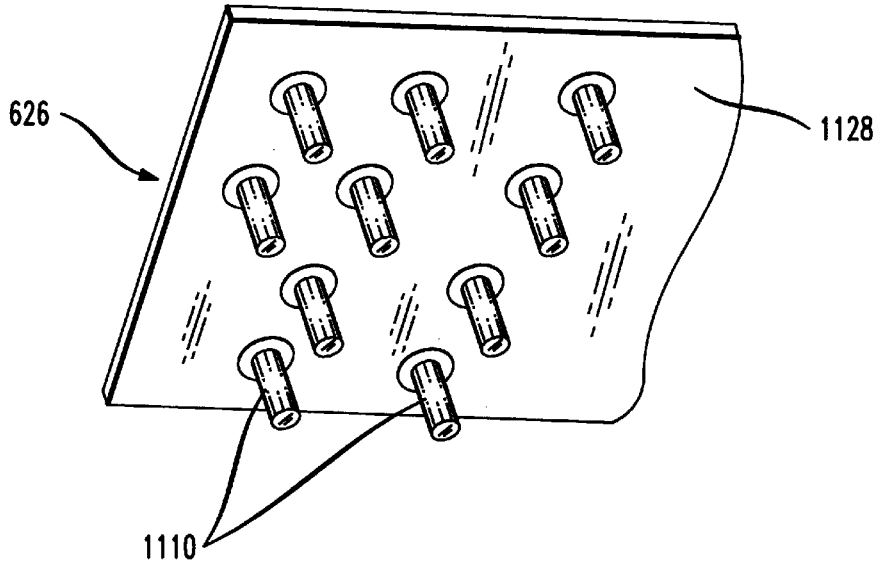
FIG. 11 is a perspective view depicting a keyboard membrane and depending upper key members in accordance with an illustrative embodiment of the present invention.

As depicted in FIG. 11, a plurality of upper key members 1110 are disposed on lower surface 1128 of keyboard membrane 626. More particularly, one upper key member 1110 is disposed directly underneath each raised region 630.

Figure 12:
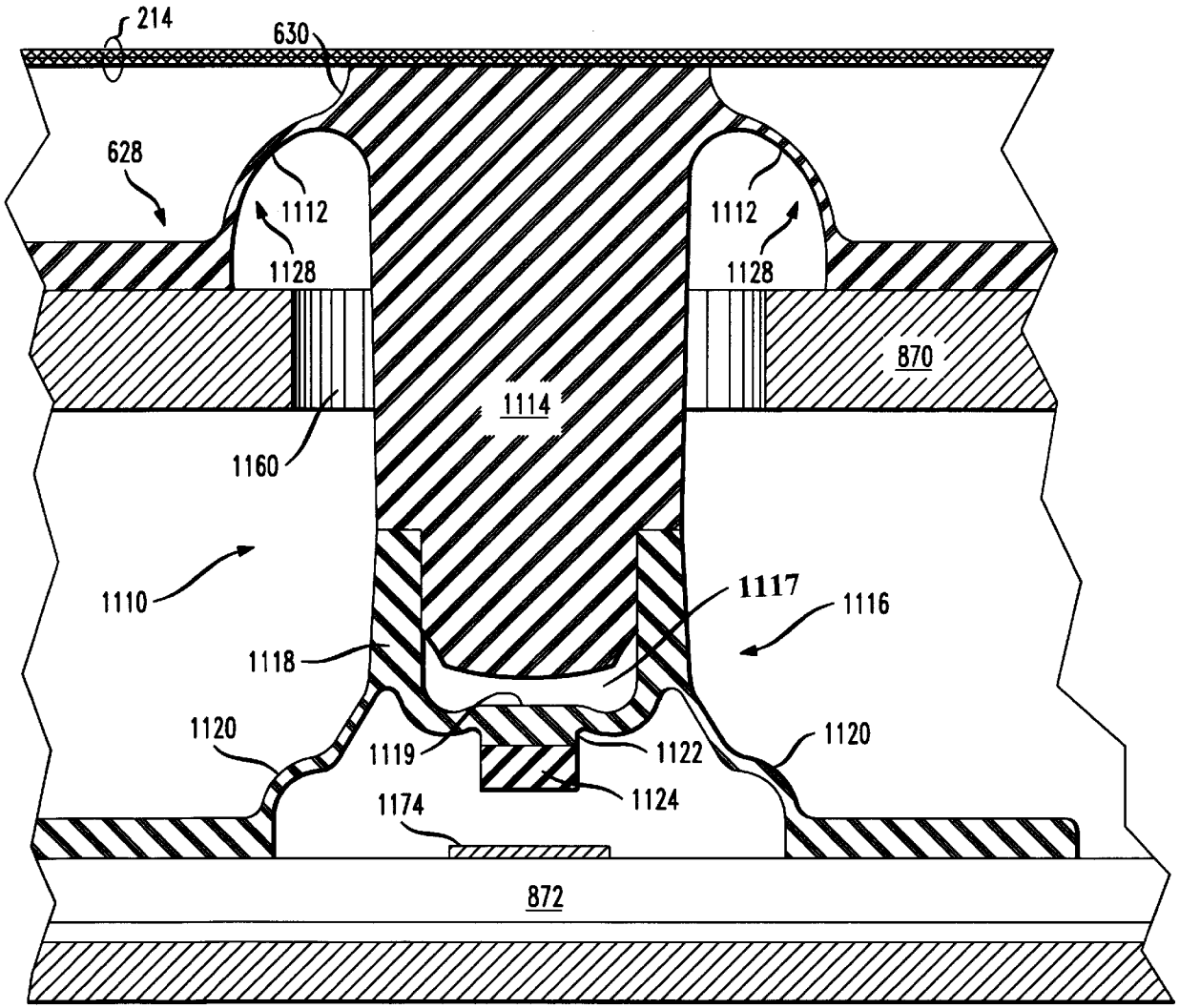
FIG. 12 depicts a cross-sectional view of a computer-style keyboard in accordance with an illustrative embodiment of the present invention.

FIG. 12 depicts a cross-sectional view of the keyboard through one of the upper key members 1110 in accordance with an illustrative embodiment of the present invention. Each upper key member 1110 is structurally adapted to provide, or includes a means for providing, a restoring force that causes the upper key member to return to an unactuated position after removal of an actuating force. In the illustrative embodiment depicted in FIG. 12, each upper key member 1110 has a first dome-shaped cap 1112 (hereinafter "dome") depending from lower surface 1128 of the upper keyboard portion. In the illustrative embodiment, each raised region 630 on upper surface 628 of keyboard membrane 626 advantageously forms first dome 1112 of each upper key member 1110. A body portion 1114 depends from each first dome 1112. Body portion 1114 of each upper key member 1110 is received by a plurality of bores 1160 in key spacer frame 870. In the illustrative embodiment, body portion 1114 has a circular cross section; however, in other embodiments, a body portion can have other suitable cross-sectional shapes, such as, for example, a "cross" ("+"). In the illustrative embodiment, small bores (not shown) ventilate gap 1117 to allow air to escape as body portion 1114 moves downwardly upon actuation. In other embodiments, such as those in which body portion 1114 has a cross-shaped cross section, the cross-sectional shape of body portion 1114 enables ventilation.

In some embodiments, raised regions 630 disposed on upper surface 628 of upper keyboard portion 626, and upper key members 1110 disposed on lower surface 1128 of the keyboard membrane 626 are advantageously molded from elastomeric layer 625. As such, the upper keyboard portion, including the plurality of raised regions 630 and plurality of upper key members 1110 comprises only a single part. Keyboard membrane 626 thus replaces over two hundred parts in conventional computer-style keyboards using sliding-plunger type key mechanisms. However, it may be desirable for molding purposes to break the keyboard into regions so that several integral parts make up the keyboard top portion. In this event, a separate seal membrane might overlay the keys where a liquid seal is desired.

A plurality of lower key members 1116 are situated beneath upper key members 1110. The lower key members are structurally adapted to provide, or includes a means for providing, a horizontally-directed centering force to the upper key member. As described in more detail later in this specification, the centering force ensures that if a user delivers an off-center strike to raised region 630, the upper key member moves along a path that is substantially unaffected by the off-center strike.

In an illustrative embodiment depicted in FIG. 12, each lower key member has a receiver portion 1118 for receiving body portion 1114 of an upper key member. Gap 1117 between body portion 1114 and bottom 1119 of receiver portion 1118 provides for over-travel as is standard for computer-style keyboards.

Second dome 1120 depends from receiver portion 1118 of each lower key member 1116, and is disposed on circuit board 872. Lower key members 1116 are formed of flexible, resilient, elastomeric material, such as silicon rubber or the like. A conductive element 1124 is disposed on undersurface 1122 of second dome 1120, directly above contact 1174 located on circuit board 872. The conductive element 1124 is advantageously formed from conductive rubber.

Figure 13:
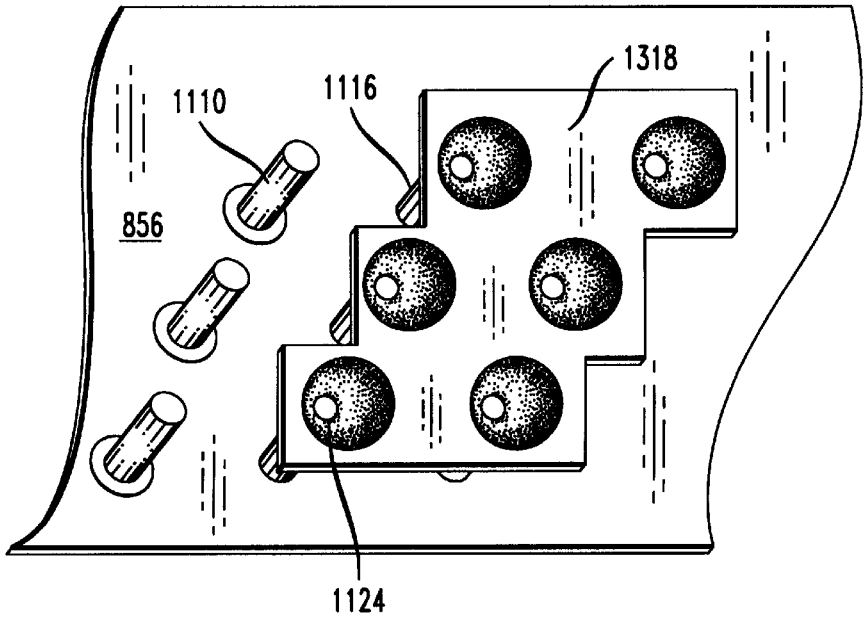
FIG. 13 depicts a bottom view of the interior of the keyboard in accordance with an illustrative embodiment of the present invention.

It was previously noted that in some embodiments, the keyboard membrane, including the plurality of upper key members 1110 and the plurality of raised regions 630, is a single part. While advantageously reducing keyboard parts count, deviations in the intended location of upper key members 1110 are likely to result given the large amount of upper key members being formed (in view of normal manufacturing tolerances). As such, lower key members 1116 are advantageously formed in relatively small groupings (e.g., 4, 6, 8 members), rather than a single large group that includes all lower key members 1116. Using small groupings of lower key members provides a greater ability to accommodate any deviations in desired upper key member 1110 location than does a single large grouping. FIG. 13, which is a bottom view of the interior of the keyboard with bottom plate 876, insulator 874 and circuit board 872 removed for clarity of illustration, depicts an illustrative grouping 1318 of six lower key members 1116.

An upper key member and a lower key member collectively comprise a "double-dome" key mechanism. Operation of the illustrative embodiment of the double-dome key mechanism is described below with reference to FIG. 14. To "type" a character, a user pushes on protective braid 214 above appropriate raised region 630 on keyboard membrane 626. The force exerted on the braid depresses raised region 630 and partially collapses first dome 1112 of upper key member 1110. To reduce the likelihood that the force applied above selected raised region 630 will affect neighboring raised regions, friction-reducing means 1334 is applied or disposed between upper surface 1432 of each raised region 630 and protective braid 214. In the illustrative embodiment depicted in FIG. 14, friction-reducing mechanism 1334 is one or more sheets of a low friction material, such as Teflon.

As first dome 1112 collapses, body portion 1114 of upper key member 1110 moves downwardly. As the body portion moves downwardly, it forces mechanically cooperating lower key member 1116 downwardly, causing second dome 1120 to partially collapse. Upon such partial collapse, conductive element 1124 disposed on undersurface 1122 of second dome 1120 engages underlying contact 1174. Upon such engagement, a signal indicative of "key strike" is generated. When the user withdraws the applied pressure, resilient, partially-collapsed lower and upper domes 1120, 1112 return to an uncollapsed state, driving body portion 1114 upwardly and restoring raised region 630 to a quiescent or unactuated position, readying that "key" for a subsequent strike.

Figure 14:
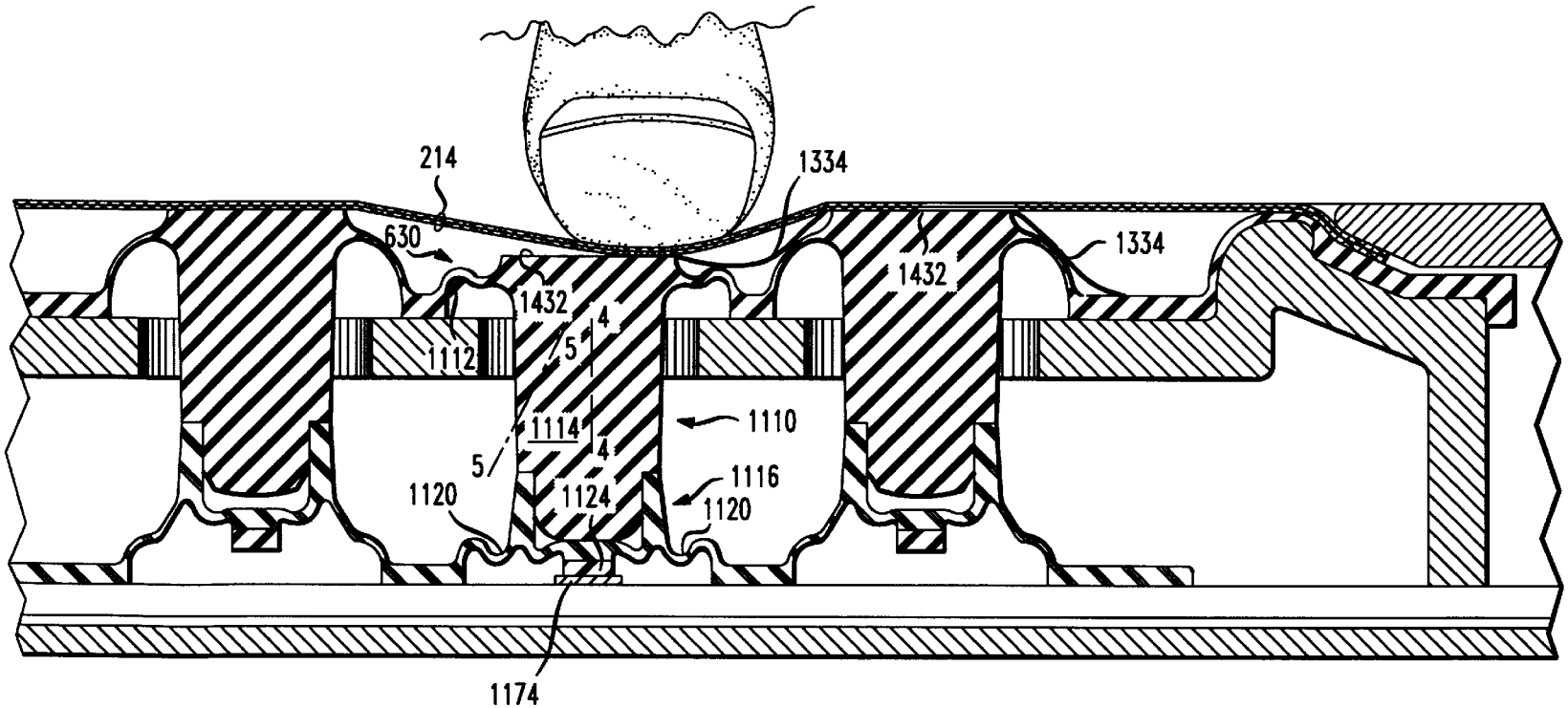
FIG. 14 is a cross-sectional view along line 3—3 (FIG. 6) depicting a computer-style keyboard in accordance with an illustrative embodiment of the present invention wherein a key is depressed with an off-center (left-right) key strike.

As previously noted, lower key member 1116 advantageously provides a "centering force" in the horizontal plane. In the illustrative embodiment, the centering force is supplied, at least in part, by resilient second dome 1120. The centering force ensures that when a user delivers an off-center key strike, as illustrated in FIG. 14, body portion 1114 moves "straight" downwardly along axis 4-4, rather than "rocking over" along axis 5-5. If body portion 1114 followed axis 5-5, conductive element 1124 would not engage contact 1174. Although the key strike illustrated in FIG. 14 is biased to the "left" edge of a "key," it should be understood that a like centering force is generated when a user contacts any edge of a key.

Figure 5:
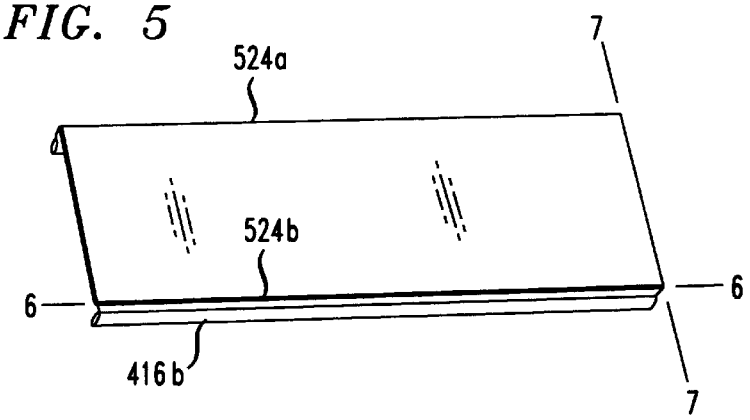
Figure 15:
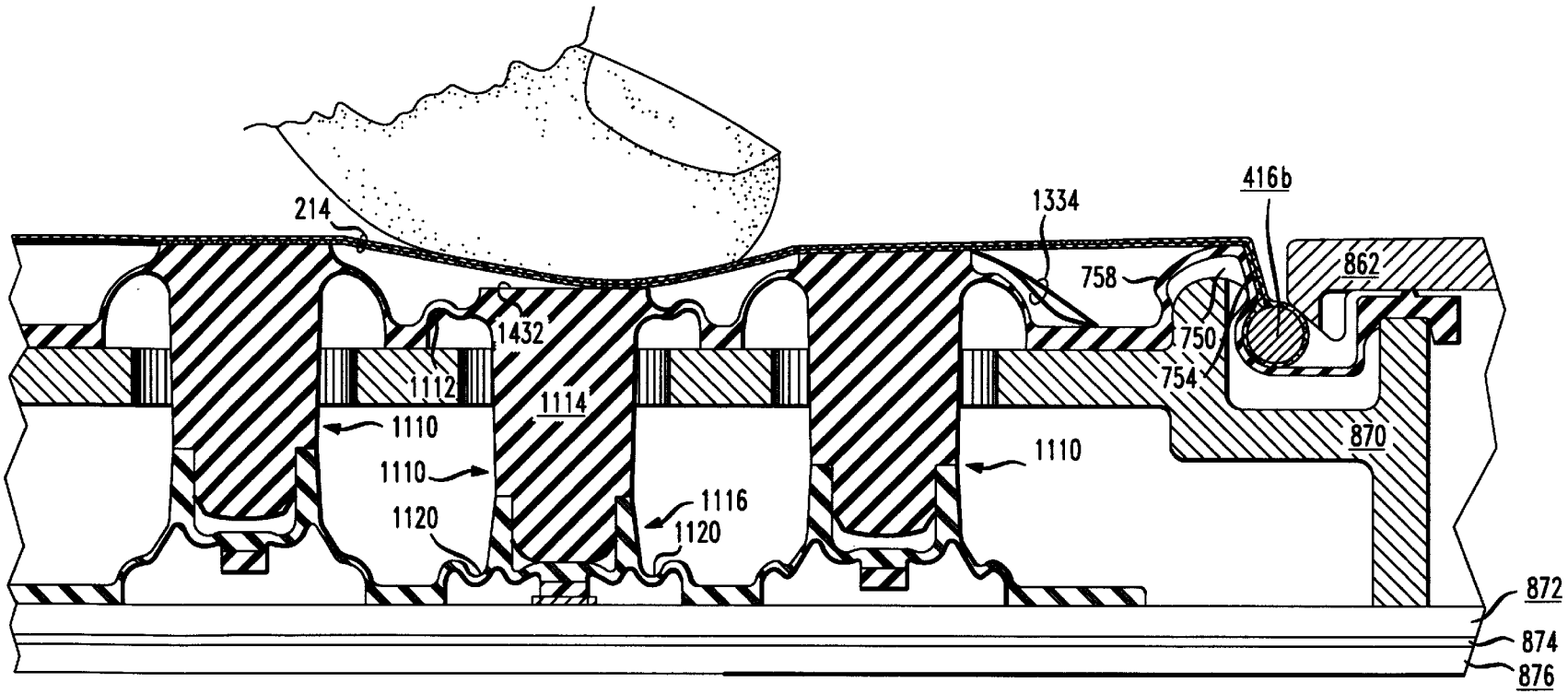
FIG. 15 is a cross-sectional view along line 4—4 (FIG. 6) depicting a computer-style keyboard in accordance with an illustrative embodiment of the present invention wherein a key is depressed with an off-center (up-down) key strike.

Protective braid 214 is not resilient in the manner of domes 1112, 1120. With reference to FIG. 5, the protective braid is resilient along long axis 6-6, but behaves like a steel cable along short axis 7-7. In some embodiments, a "short-axis" resilience is advantageously provided by a "compliant edge." In an illustrative embodiment depicted in FIG. 15, the compliant edge is upper portion 754 of first riser wall 750. As protective braid 214 is depressed, upper portion 754 of first riser wall 750 is forced away from keyboard housing 862, and second riser wall 758 is deformed, as well. As a user's finger is removed from protective braid 214, the riser walls return to their undeformed shape, placing protective braid 214 under tension and substantially removing any slack that would otherwise remain.

It is to be understood that the embodiments described herein are merely illustrative of the many possible specific arrangements that can be devised in application of the principles of the invention. Other arrangements can be devised in accordance with these principles by those of ordinary skill in the art without departing from the scope and spirit of the invention. It is therefore intended that such other arrangements be included within the scope of the following claims and their equivalents.

I claim:

1. An article for data terminal emulation, comprising:

a telephone operable to send and receive information;

an alphanumeric display operable to display the sent or received information; and a keyboard for entering the information to be sent, the keyboard comprising a housing; a plurality of keys; each of said keys having an upper raised region which a user depresses to actuate a particular key; and a wire braid disposed over the upper raised regions of said plurality of keys and secured to the keyboard, said wire braid providing physical protection to the keyboard.

2. The article of claim 1, wherein character designators are disposed on the wire braid.

3. A robust computer-style keyboard suitable for use in a harsh environment comprising:

a keyboard housing a plurality of keys, each key having a top surface which a user presses to activate a particular key; and a wire braid disposed over the top surfaces of the plurality of keys and secured to the keyboard, said wire braid providing physical protection to the keyboard.

4. The keyboard of claim 3 wherein the wire braid further comprises key labels for the plurality of keys located beneath the wire braid.

5. The keyboard of claim 3 further comprising a seal membrane adapted to provide a substantially liquid-tight seal.

6. The keyboard of claim 3 wherein the plurality of keys comprises an upper keyboard membrane adapted to provide a substantially liquid-type seal.

* * * * *